United States Patent [19]

Vanderhoek et al.

[11] 4,178,861

[45] Dec. 18, 1979

[54] METHOD FOR THE DELIGNIFICATION OF LIGNOCELLULOSIC MATERIAL IN AN AMINE DELIGNIFYING LIQUOR CONTAINING A QUINONE OR HYDROQUINONE COMPOUND

[75] Inventors: Naphtali N. Vanderhoek, Doncaster; Peter F. Nelson, Kew; Alan Farrington, Donvale, all of Australia

[73] Assignee: Australian Paper Manufacturers Limited, Melbourne, Australia

[21] Appl. No.: 860,058

[22] Filed: Dec. 13, 1977

[30] Foreign Application Priority Data

Dec. 13, 1976 [AU] Australia ..... PC8476

[51] Int. Cl.[2] ..... D21C 1/00; D21C 3/22; D21C 3/26

[52] U.S. Cl. ..... 162/72; 162/90

[58] Field of Search ..... 162/90, 72

[56] References Cited

U.S. PATENT DOCUMENTS

| | | | |
|---|---|---|---|
| 2,218,479 | 10/1940 | Peterson et al. | 162/72 |
| 3,888,727 | 6/1975 | Kenig | 162/72 |
| 4,012,280 | 3/1977 | Holton | 162/65 |
| 4,045,280 | 8/1977 | Mackie | 162/90 |
| 4,091,749 | 5/1978 | Procter et al. | 162/72 |

FOREIGN PATENT DOCUMENTS

| | | | |
|---|---|---|---|
| 986682 | 4/1976 | Canada | 162/72 |
| 2355741 | 6/1974 | Fed. Rep. of Germany | 162/72 |
| 51-43403 | 4/1976 | Japan | 162/72 |

OTHER PUBLICATIONS

Bach et al., "New Possibilities for Carbohydrate Stabilization in Alkaline Cooking", Papier (i) 3 (1972).

*Primary Examiner*—S. Leon Bashore
*Assistant Examiner*—Steve Alvo

[57] ABSTRACT

A delignification process using amine cooking liquors which also contain a quinoid or hydroquinoid compound. The process also encompasses a pretreatment step using the quinoid or hydroquinoid compounds.

14 Claims, 2 Drawing Figures

Figure 1:
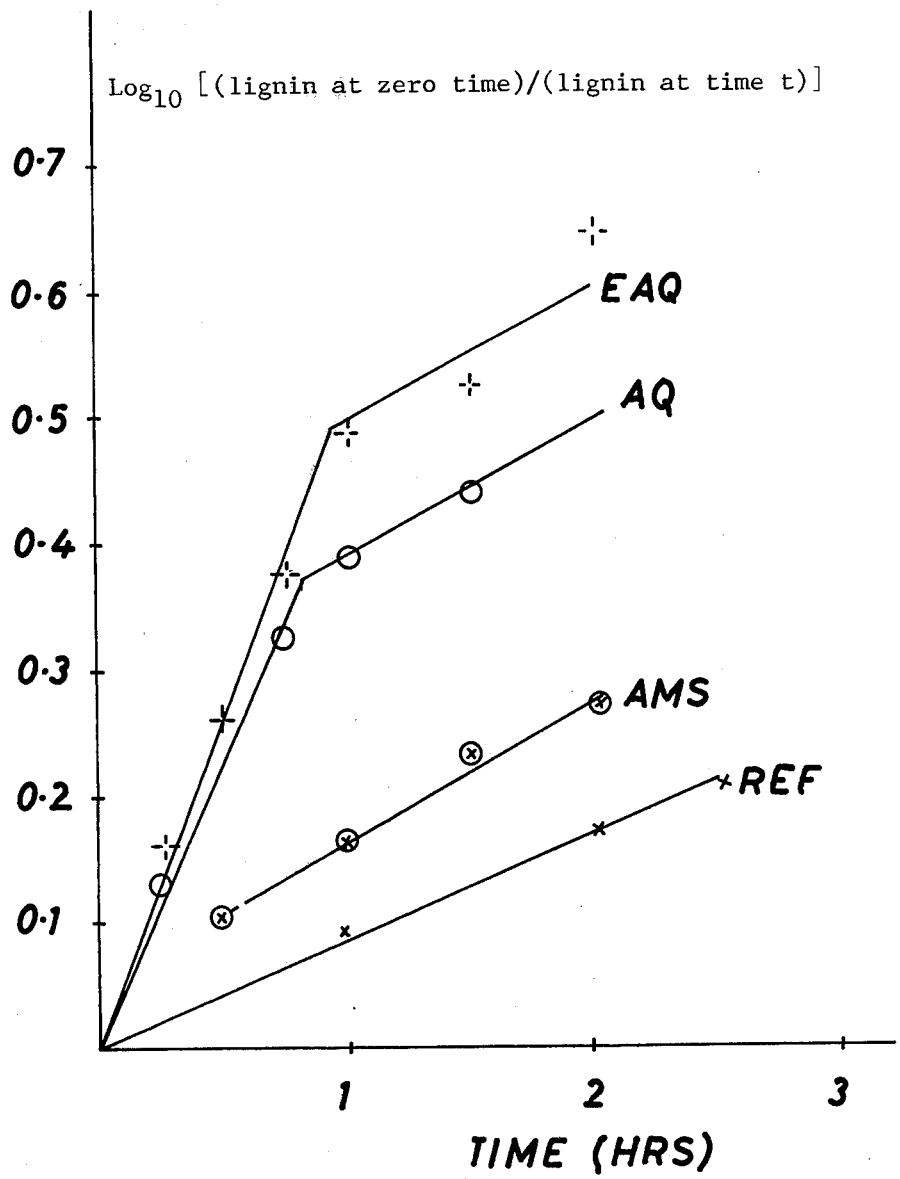

METHOD FOR THE DELIGNIFICATION OF LIGNOCELLULOSIC MATERIAL IN AN AMINE DELIGNIFYING LIQUOR CONTAINING A QUINONE OR HYDROQUINONE COMPOUND

The present invention relates to cellulosic pulping processes in which delignification of lignocellulosic materials is effected for the production of cellulosic pulps of the type which may be used in the manufacture of paper or paper-board.

Cellulosic pulp production for paper or paperboard making is normally conducted in aqueous systems using chemical agents soluble therein. Such processes generally suffer from the disadvantage that inorganic chemicals used for the purpose must be recovered on economic grounds for re-use by a complex and expensive chemical recovery system. Moreover, disposal of the effluents produced by such processes may present environmental problems.

Literature relating to pulping technology lists many examples of the use of non-aqueous solvents designed to obviate or minimize these problems. In most cases only very limited success has been achieved due to the need to employ relatively vigorous chemicals, often inorganic acids and bases, together with the solvents in order to promote separation of lignin from carbohydrates and dissolution of the lignin.

Amines such as the alkanolamines, alkylene diamines and polyalkylene polyamides derived therefrom represent classes of amine solvents with pronounced basic properties some members of which have been shown to be capable of delignifying wood or other lignocellulosic raw materials to produce pulp. However the use of these compounds involves relatively long reaction times and/or high temperatures and pressures in order to achieve efficient delignification.

We have now discovered that the limitations in the use of such amines for the delignification of lignocellulosic raw materials can be largely overcome by the conjoint use of a quinonoid compound or hydroquinonoid compound, whereby the rate at which the lignin is removed from the lignocellulosic raw material is markedly increased, when compared with the corresponding pulping procedure conducted in the absence of such a compound.

Thus, in accordance with the present invention there is provided a process for the delignification of lignocellulosic raw materials in the production of cellulosic pulps suitable for use in the manufacture of paper or paperboard and the like, which comprises pretreating the lignocellulosic raw material with a quinonoid or hydroquinonoid compound in an amine pretreatment liquor and/or cooking the lignocellulosic raw material with a quinonoid or hydroquinonoid compound in an amine cooking liquor.

The term amine as used throughout this specification in reference to pretreatment or cooking liquors refers to basic amines which are suitable for delignifying lignocellulosic raw materials either alone or in conjunction with other alkaline liquors. The amine liquor may include other pulping chemicals particularly sodium hydroxide but must include at least 5% by weight of the amine. In particular alkanolamines, alkylene diamines, and polyalkylene polyamines are suitable amine compounds for this purpose. Of the alkanolamines the ethanolamines (including mono-, di-, and triethanolamine) and the isopropanolamines or 2-propanol-amines (including mono-, di-, and tri-isopropanolamines) are preferred with mono ethanolamine being the preferred compound. Preferred alkylene diamines are those diamino lower alkanes such as ethylene diamines and propylene diamines. Preferred polyalkylene polyamines are derivatives of the lower alkylene diamines such as diethylenetriamine and triethylenetetramine.

The term quinonoid or hydroquinonoid compound used throughout this specification means compounds selected from quinone, anthraquinone, phenanthrenequinone, naphthoquinone, anthrone, benzoquinone, anthrahydroquinone, hydroquinone, naphthohydroquinone, phenanthrahydroquinone, benzohydroquinone or the alkyl, alkoxy, hydroxy, amino, halo or carboxy derivatives of said quinone or hydroquinones and also includes the tautomeric and precursor forms of said quinones or hydroquinones. The hydroquinone compounds need not be added directly to the amine liquor, instead the corresponding quinone compound can be added, with an effective amount of a reducing agent where it is needed, to produce the desired hydroquinone compound in situ.

The amount of quinonoid/hydroquinonoid compound required for delignification may vary considerably, depending to a substantial extent on the particular process to be used. Generally for commercial purposes the presence of a relatively small quantity, for example, from 0.001 to 5% by weight, based on the oven dry lignocellulosic raw material, is sufficient. Preferably the quinonoid/hydroquinonoid compound is employed in an amount of from 0.001 to 0.5% and most preferably about 0.1%–0.3% by weight as indicated.

For convenience of description, the reference hereinafter to quinonoid compounds is to be read as embracing the corresponding hydroquinonoid compounds. Thus, quinonoid compounds, that is compounds having a quinone nucleus, suitable for use in the lignocellulosic delignification process according to the invention include: the benzoquinones, including tetrahydroxybenzene, the naphthoquinones, the anthraquinones, the phenanthraquinones, the derivatives of any of such compounds, the precursors of any of such compounds, or mixtures of any of such compounds and/or their precursors.

Anthraquinones are the preferred quinonoid compounds for use in accordance with the invention. Example of anthraquinone compounds which may be so used include anthraquinone, 1- and 2-alkylanthraquinones (e.g. alkyl groups of $C_{1-7}$, particularly 2-ethyl and tert. butyl anthraquinone), 1- and 2-aminoanthraquinones, 1- and 2-hydroxyanthraquinones, 1- and 2-haloanthraquinones, and their sulfonates and salts, for instance sodium anthraquinone-2-sulfonate. The corresponding benzoquinones, naphthoquinones and phenathraquinones, for instance, naphthoquinone, hydroxynaphthoquinone, or sodium naphthoquinone-2-sulfonate, may likewise be used.

A wide variety of lignocellulosic raw materials may be used in carrying out the process of the invention.

By way of example, suitable lignocellulosic raw materials for the pulp include softwood chips, hardwood chips, whole tree chips from softwood or hardwood trees, sawdust and non-woody cellulosic raw materials such as bagasse (sugar cane residues), kenaf, straw and other annual plants and crops. Whole tree chips include chips from various parts of a tree including the bark, branches, leaves and roots.

Treatment of the lignocellulosic raw material with the quinonoid/hydroquinonoid compound for delignification in accordance with the invention may be varied to suit the requirements of the particular process. For instance, the quinonoid/hydroquinonoid compound may be present in the pretreatment liquor in which the lignocellulosic raw material is soaked or impregnated before addition to cooking liquor in a digester for completion of the delignification process; or the compound may be pre-mixed with the cooking liquor and lignocellulosic raw material before addition to the digester for cooking under variable conditions; or the compound may be added directly to the cooking liquor and lignocellulosic raw material in the digester, either in a single charge or in several charges at different stages of the digestion or continuously throughout the digestion.

Based on experiments which were carried out in the use of quinonoid or hydroquinonoid compounds in the delignification of lignocellulosic raw materials in aqueous alkali pretreatment or cooking liquors, it is surmised that in using an alkanolamine pretreatment or cooking liquor as herein, the preferred quinonoid compound of the series will likewise be the compound with the lowest redox potential, since it has been found that there is a general trend towards progressively enhanced rates of delignification with the lowering of the redox potential of the quinonoid compound in aqueous alkali pulping processes. This will be seen from FIG. 1 of the accompanying drawings, as explained below, said figure illustrating the rate of removal of lignin from 20 g. of O.D. *P.elliottii* wood meal in 330 ml. of 1.5 M sodium hydroxide and 1% of anthraquinone (AQ) or 2-ethylanthraquinone (EAQ) or sodium anthraquinone-2-sulfonate (AMS), the legend REF indicating as absence of quinonoid compound and the lignin content being measured by the APPITA Standard Method P6m-68.

Thus, with reference to FIG. 1 of the accompanying drawings, it will be seen that relative to anthraquinone, the presence of an electron-withdrawing substituent such as sulfonate in the anthraquinone nucleus, which increases the redox potential, resulted in a decrease of the delignification activity. On the other hand, the presence of the ethyl group in the anthraquinone nucleus, in being representative of electron-donating substituents which decrease the redox potential, resulted in an increase of the delignification activity.

Figure 2:
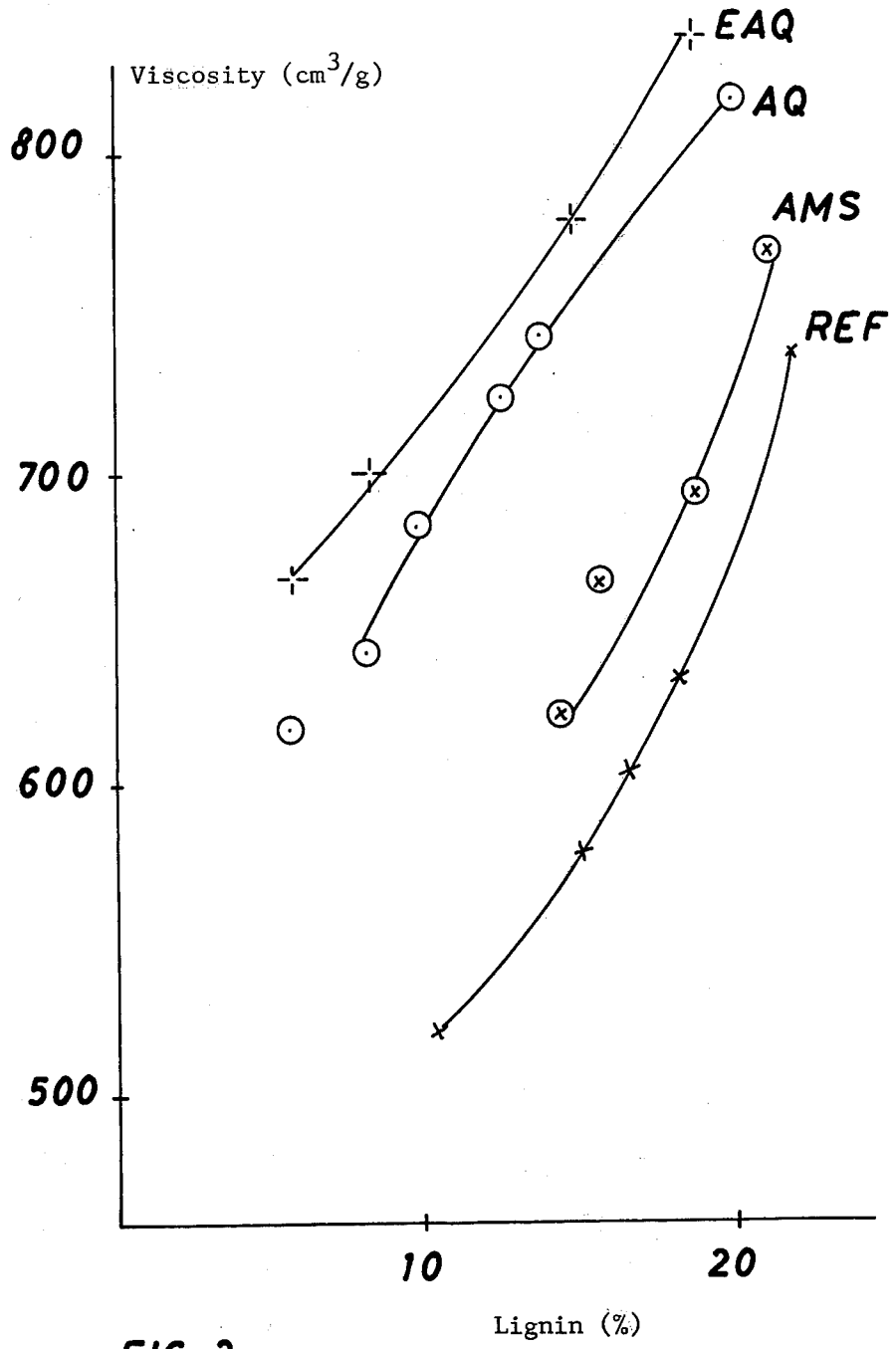

FIG. 2 of the accompanying drawings, which is to be read in conjunction with FIG. 1 of the accompanying drawings, will moreover be seen to indicate that use of the quinonoid compounds with lowered redox potential resulted in the production of relatively better quality pulp. Thus, the pulps of progressively higher viscosity, which indicates less degradation and hence better quality, are produced with anthraquinones of progressively lowered redox potential.

The mechanism which results in the quinonoid compound facilitating delignification of the lignocellulosic raw material, by increasing the rate at which lignin is removed therefrom during the pulping process, is not fully understood. It is presumed however that such mechanism is essentially based upon the formation and delignification activity of the corresponding hydroquinonoid compound on the lignocellulosic raw material in the pulping liquor.

Further it is suspected that in the course of the pulping process, the hydroquinonoid may be converted back to the quinonoid compound. Since a cyclic process, in which the quinonoid compound is first reduced and then reoxidised, would offer an explanation of the remarkably effective delignification obtained in accordance with the invention, in which the quinonoid/hydroquinonoid compound may be employed in very small quantities and thus may be regarded as having a catalytic effect on delignification.

Pretreatment or preparatory pulping of the lignocellulosic raw material in accordance with the process of the invention, can be in accordance with any one or any combination of steps (A), (B) and (C) below, which are variations of conventional pulping procedures aimed at obtaining a better penetration and diffusion of the quinonoid compound into the lignocellulosic raw material before the pulp is subjected to a cooking temperature above about 130° C., so as to enhance the beneficial effects of quinonoid compounds in the delignification of the lignocellulosic raw material:

(A) normal pressure or positive pressure (hydraulically or pneumatically applied) or negative pressure (vacuum) impregnation of the lignocellulosic raw material in an amine solution of the quinonoid compound at temperatures from ambient to 130° C., which solution may be the cooking liquor or a liquor which is drained off following impregnation and then replaced with a fresh amine cooking liquor; or (B) prolongation of the time normally taken to raise the temperature of the lignocellulosic raw material and alkanolamine cooking liquor containing the quinonoid compound from ambient to maximum cooking temperature up to about 250° C., or (C) maintaining the lignocellulosic raw material and amine cooking liquor containing the quinonoid compound at a temperature within the range of 100°–130° C. for a period from 15 to 60 minutes and then continuing the normal rate of temperature increase to the maximum cooking temperature up to about 250° C., in each case the maximum cooking temperature being subject to the boiling point of the selected amine.

In operating step (A) above, the impregnation period may extend up to 1 hour, before proceeding with the cooking process, which may be conducted where possible at a temperature up to 250° C. but preferably up to 200° C. for a period of 1–6 hours; in operating step (B) above, the prolongation period may extend up to 2–3 hours, before proceeding with the cooking process as in step (A) above; and in operating step (C) above, the period taken to reach the temperature of 100°–130° C. may be from 15 minutes to 2 hours, whilst the period of cooking after the 15–60 minutes delay at 100°–130° C. may be from 1–6 hours at temperatures as in step (A) above.

Ordinarily, the amine pretreatment or cooking liquor is presumed to function as a reducing agent to solubilise the anthraquinone or other such quinonoid compound by reduction to the hydroquinonoid or other form, in the course of effecting delignification of the lignocellulosic raw material. In cases where the degree of reduction of the selected quinonoid compound by the selected alkanolamine is inadequate, a supplementary reducing agent may be added to the pretreatment or cooking liquors so as to solubilise the quinonoid compound to an optimum extent in said liquors for penetration and diffusion into the lignocellulosic raw material and to be available to exert optimised beneficial effects.

Suitable supplementary reducing agents for this purpose are organic compounds or compositions or mixtures of such compounds or compositions. Preferred organic reducing agents include carbohydrates such as glucose, xylose, mannose, or other disaccharides, oligosaccharides such as raffinose, or polysaccharides such as starch or xylan; glycols, oligomeric and polymeric glycols; amines, such as ethylene diamine or diethylene triamine or a kanolamines; or aldehydes such as formaldehyde, acetaldehyde or vanillin; or spent cooking liquor (black liquor); or liquor withdrawn from a cook after an appreciable dissolution of reducing substances has occurred, that is, at some point in the temperature range 100°-170° C. and preferably in the range of 120°-140°, which in practice can be achieved:

(a) in batch cooking, by draining some cooking liquor at the required temperature in the range 100°-170° C. and recycling this to the impregnation stage of the next cook; or (b) in batch cooking, by re-use of black liquor obtained at the end of a cook, or at the end of one or more stages of a cook involving two or more stages, in the succeeding cook or in one or more stages of a succeeding cook of two or more stages; or (c) in continuous cooking, by draining some cooking liquor from a point close to the top of the continuous digester and recycling this to a continuous impregnation stage.

Quinonoid compounds which are devoid of sulphur are generally preferred for use in the process of the invention because they are suitable for so-called "sulphur-free" processing. Such processing is generally considered desirable since the absence of sulphur avoids the possibility of the process emitting obnoxious sulphur compounds into the atmosphere and thereby causing environmental pollution.

In practice, the quinonoid compound is conveniently employed by direct addition to the amine cooking liquor containing the lignocellulosic raw material in the digester. When the quinonoid compound is employed in the solid form, it is preferably of small particle size, hence the quinonoid compound may be ground before its addition to the digester, preferably to a size which passes through a 36 mesh British standard screen.

The practical examples set out below, demonstrate the process of the invention, the pulping conditions quoted for each such example being those which give close to maximum screen yield for the pulping chemicals used, and pulp strengths were determined using Appita Standard Methods and the PFI mill.

EXAMPLE 1

A charge of 20 g of *P.elliottii* wood meal was heated in a stainless steel digester with 330 ml of monoethanolamine for 3 hr. at 170° C. The resulting pulp was filtered and washed and found to have the following properties:

Lignin content (%)—14.8
Viscosity ($cm^3/g$)—1140

EXAMPLE 2

A charge of 20 g of *P.elliottii* wood meal was treated under the conditions of Example 1 except that 0.2 g of anthraquinone was added. The properties of the resulting pulp were:

Lignin content (%)—8.2
Viscosity ($cm^3/g$)—1215

EXAMPLE 3

A charge of 20 g of *P.elliottii* wood meal was treated under the conditions of Example 1 except that heating was for 5 hr. The resulting pulp had the following properties:

Lignin content (%)—13.3
Viscosity ($cm^3/g$)—1195

EXAMPLE 4

A charge of 20 g of *P.elliottii* wood meal was treated as in Example 3 except that 0.2 g of anthraquinone was added to the monoethanolamine. The resulting pulp had the following properties:

Lignin content (%)—5.4
Viscosity ($cm^3/g$)—1215

EXAMPLE 5

A 200 g charge of *P.elliottii* chips was heated with 1 liter of monoethanolamine in a stainless steel digester for 5 hr. at 170° C. The resulting cooked chips were disintegrated mechanically and the pulp obtained washed and collected by filtration. Pulp yield was 68.1% with a Kappa number of 89.5.

EXAMPLE 6

A 200 g charge of *P.elliottii* chips was treated as in Example 5 except that 0.2 g of anthraquinone was added to the digester together with the ethanolamine. Pulp yield was 63.6% with a Kappa number of 67.1.

EXAMPLE 7

A 200 g charge of *P.elliottii* chips was treated as in Example 5 except that heating was for 5 hr. at 180° C. The pulp obtained was disintegrated and converted into handsheets. The properties of pulp and handsheets were as follows:

Pulp yield—61.1%
Kappa number—51.2
Burst index—5.0—$kPam^2/g$
Tear index—17.2—$mNm^2/g$
Breaking length—6.3—km.

(Strengths measured after refining to 600 Canadian Standard Freeness).

EXAMPLE 8

A 200 g charge of *P.elliottii* chips were treated as in Example 7 except that 0.2 g of anthraquinone was added together with the monoethanolamine. The properties of the resulting pulp and handsheets were as follows:

Pulp yield—60.6%
Kappa number—37.7
Burst index—5.5—$kPam^2/g$
Tear index—17.8—$mNm^2/g$
Breaking length—6.9—km.

(Strengths measured after refining to 600 Canadian Standard Freeness).

EXAMPLE 9

A 200 g charge of *P.elliottii* chips was treated as in Example 5 except that heating was for 4 hr. at 190° C. The pulp obtained was disintegrated and converted into handsheets. The properties of pulp and handsheets were as follows:

Pulp yield—59.6%
Kappa number—26.8
Burst Index—6.0—kPa $m^2/g$

Tear Index—17.0—mNm²/g
Breaking Length—7.0—km
(Strengths measured after refining to 600 Canadian Standard Freeness).

EXAMPLE 10

A 200 g charge of *P.elliottii* chips was treated as in Example 6 except that heating was for 2.5 hr. at 190° C. The pulp obtained was disintegrated and converted into handsheets. The properties of pulp and handsheets were as follows:

Pulp yield—59.7
Kappa number—34.6
Burst index—5.6—kPa m²/g
Tear index—17.9—mNm²/g
Breaking length—6.9—km
(Strengths measured after refining to 600 Canadian Standard Freeness).

EXAMPLE 11

A 250 g charge of *P.radiata* chips was heated in a stainless steel digester with 222 ml of ethylene diamine and 778 ml of water for five hours at 170° C. The resulting pulp, after filtration and washing was obtained in a yield of 72% with Kappa number 136.

EXAMPLE 12

A 250 g charge of *P.radiata* chips was treated as in Example 11 except that 0.5 g of anthraquinine was added to the ethylene diamine before addition to the chips. After filtration and washing the pulp yield was 68% with a Kappa number of 106.

Some of the advantages of the present invention can be observed by considering the foregoing examples. Thus, it is evident that addition of an amount of anthraquinone equal to 0.1% by weight of the weight of the wood chips enables the same degree of delignification to be obtained in 3 hours cooking, as requires 5 hours cooking in the absence of anthraquinone, with substantially no decrease in the quality of the pulp obtained.

The examples given above relate to a very limited range of operating conditions which are not necessarily critical for satisfactory performance of the invention. Consequently, it is to be understood that the invention is not limited to the particular process parameters or other features specified in the examples.

In particular, it is to be understood that the process of the invention may be applied to a wide variety of pulping process physical parameters and raw materials. For example, the temperature of the pulping process may be varied over a wide range although preferably the process is conducted at a temperature between 50° and 250° C., subject to the boiling point of the amine used in the process.

Although the process of the invention may be operated advantageously as a non-aqueous pulping system (excluding water which may enter with the wood chips) there are circumstances in which a substantially aqueous system is preferred. Also the process of the invention may be applied to pulping procedures including those which involve one or more stages; those carried out by batch or continuous operation including either concurrent or countercurrent operation; and those conducted in other solvent solutions.

Thus, the process of the invention may be suitably modified for operation as a combination amine/alkali process, in which the amine pretreatment and/or cooking liquor contains sodium hydroxide solution or other pulping chemicals.

For instance, wood chips or other lignocellulosic raw material may be impregnated with an amine liquor containing a quinonoid or hydroquinonoid compound, followed by addition of other pulping chemicals, such as sodium hydroxide solution, or the amine liquor containing the quinonoid or hydroquinonoid compound may be added directly to the digester with the wood chips or other lignocellulosic raw material and the other pulping chemicals.

It will be appreciated that it is possible to vary the ratios of the quinonoid or hydroquinonoid compound and amine to sodium hydroxide or other pulping chemical in the pretreatment or cooking liquor to obtain pulp properties appropriate to various purposes. Indeed in one particular embodiment of the invention, the amine may be a relatively minor proportion of the pretreatment or cooking liquor, for example, as low as 5% but preferably no lower than 10% by weight, based on the oven dry lignocellulosic raw material.

In the case where the amine is a relatively minor proportion of the pretreatment or cooking liquor, the use of a supplementary reducing agent to obtain adequate solubility of anthraquinone or other quinonoid compounds not being hydroquinonoid compounds, by reduction to the hydroquinonoid form, is generally required. In such case the reducing agent may be an inorganic or organic compound or compositions or mixtures of them, the organic reducing agents suitably being as set out above, whilst the inorganic reducing agents may include sodium or zinc dithionite (hydrosulphite), sodium borohydride, or zinc powder and sodium hydroxide.

When supplementary reducing agent is used in the cooking liquor in such cases, there may be some instances in which it becomes exhausted or destroyed as the cooking process proceeds, resulting in the reducing effect being substantially diminished or entirely lost. In such instances it would be advantageous to add increments of the reducing agent periodically by injection into the digester in order to maintain a sufficient amount of the supplementary reducing agent present in the cooking liquor.

Also, in such cases, a surfactant or mixture of surfactants may be additionally employed in the pretreatment liquor or cooking liquor. Suitable surfactants include sodium secondary alkyl sulfates, for example, Teepol (Trade Name); substituted amides of long-chain aliphatic acids, for example, Busperse (Trade Name); and polyethylene oxide types.

In the case where the quinonoid or hydroquinonoid compound and amine are used without addition of inorganic pulping chemicals such as sodium hydroxide, the process has the advantage of a simplified recovery process without the need for a recovery furnace suitable for the recovery of inorganic chemicals. On the other hand, in the case where inorganic pulping chemicals are used, it is advantageous to be able to recover non-consumed anthraquinone or other quinonoid or hydroquinonoid compound, since they are expensive chemicals.

The interpretation given above as to the chemical mechanism responsible for the activities found in the process according to the present invention is the present understanding of what is involved in the operation of the invention. A modified understanding may well be found in future, hence the foregoing theory should not be regarded as absolute, nor should the advantages and benefits of the invention herein disclosed be considered in any way dependent upon this or any other interpretation.

Various alterations and/or modifications may be introduced into the foregoing description without departing from the spirit or scope of the invention.

The claims defining the invention are as follows:

1. A process for the delignification of lignocellulosic raw materials in the production of cellulosic pulps suitable for use in the manufacture of paper or paperboard which consists of pretreating the lignocellulosic raw material with a quinone or a hydroquinone compound in an essentially non-aqueous pretreatment liquor consisting of an amine delignifying liquor and cooking the lignocellulosic raw material with the pretreatment liquor or another amine delignifying liquor.

2. A process as claimed in claim 1 wherein said quinone or hydroquinone compound is present within the range of 0.001 to 5% by weight based on the oven dry lignocellulosic raw material.

3. A process as claimed in claim 1, wherein said quinone compound is anthraquinone, 1 or 2-alkyl anthraquinone, 1 or 2-amino-anthraquinone, 1- or 2-hydroxy anthraquinone, 1- or 2-haloanthraquinone.

4. A process as claimed in claim 1 in which a quinone compound is added to the pretreatment liquor in conjunction with an effective amount of a reducing agent to produce the corresponding hydroquinone compound.

5. A process according to claim 1 wherein the amine is an alkanolamine, an alkylene diamine or a polyalkylene polyamine.

6. A process as claimed in claim 5 wherein the amine is monoethanolamine.

7. A process according to claim 1 wherein said quinone compound is 2-ethyl anthraquinone.

8. The process according to claim 1 wherein an effective amount of a reducing agent is added to both said pretreatment liquor and the other delignifying liquor to produce the corresponding hydroquinone compound.

9. The process according to claim 1 wherein the temperature is up to 130° C.

10. A process for the delignification of lignocellulosic raw materials in the production of cellulosic pulps suitable for use in the manufacture of paper or paperboard and the like, which consists of cooking said lignocellulosic raw materials with a quinone or hydroquinone compound in an essentially non-aqueous cooking liquor consisting of an amine.

11. The process according to claim 10 wherein an effective amount of a reducing agent is added to said cooking liquor to produce the corresponding hydroquinone compound.

12. The process according to claim 10 wherein said quinone or hydroquinone compound is present within the range of 0.001 to 5% by weight based on the oven dry lignocellulosic material.

13. The process according to claim 10 wherein said quinone compound is anthraquinone, 1 or 2-alkyl anthraquinone, 1 or 2-amino-anthraquinone, 1- or 2-hydroxy anthraquinone, 1- or 2-haloanthraquinone.

14. The process according to claim 10 wherein the temperature is up to 250° C.

* * * * *